US007849863B2

(12) United States Patent
Corbellini

(10) Patent No.: US 7,849,863 B2
(45) Date of Patent: Dec. 14, 2010

(54) VERSATILE, TRI-FOLD COMPACT WITH DECOUPLED MOTION

(75) Inventor: Francis Corbellini, Thiais (FR)

(73) Assignee: ELC Management LLC, New York, NY (US)

( * ) Notice: Subject to any disclaimer, the term of this patent is extended or adjusted under 35 U.S.C. 154(b) by 594 days.

(21) Appl. No.: 11/612,793

(22) Filed: Dec. 19, 2006

(65) Prior Publication Data

US 2008/0142031 A1 Jun. 19, 2008

(51) Int. Cl.
*A45D 33/22* (2006.01)

(52) U.S. Cl. ..... 132/295; 220/813

(58) Field of Classification Search ..... 132/200, 132/286, 287, 293–296; 206/823, 581, 758, 206/759, 45.2, 267; 220/811–813
See application file for complete search history.

(56) References Cited

U.S. PATENT DOCUMENTS

| | | | | |
|---|---|---|---|---|
| 234,280 | A | 11/1880 | Hopfen | |
| 238,959 | A | 3/1881 | Parker | |
| 343,678 | A | 6/1886 | Tatum | |
| 947,198 | A | 1/1910 | Herzstam | |
| 1,247,848 | A | 11/1917 | List | |
| 1,675,496 | A | 7/1928 | Kasdan et al. | |
| 1,678,282 | A | 7/1928 | Coryell | |
| 1,693,151 | A | 11/1928 | Mayer | |
| 1,698,750 | A | 1/1929 | Coryell | |
| 1,720,274 | A | 7/1929 | Holden | |
| 1,734,116 | A | 11/1929 | Coryell | |
| 1,734,117 | A | 11/1929 | Coryell | |
| 1,793,192 | A | 2/1931 | Poranski | |
| 1,904,364 | A | 4/1933 | Fullmer | |
| 1,925,316 | A * | 9/1933 | Fullmer | 132/287 |
| 1,997,043 | A | 4/1935 | Clark | |
| 2,031,933 | A * | 2/1936 | Clegg | 132/287 |
| 2,441,303 | A | 3/1946 | Wesson et al. | |

(Continued)

FOREIGN PATENT DOCUMENTS

| | | |
|---|---|---|
| JP | 61118508 | 7/1986 |

(Continued)

OTHER PUBLICATIONS

PCT International Search Report; International Application No. PCT/US07/086799; Completion Date: May 7, 2008; Date of Mailing: May 7, 2008.

(Continued)

*Primary Examiner*—Rachel R Steitz
(74) *Attorney, Agent, or Firm*—Peter Giancana

(57) ABSTRACT

A versatile, convenient-to-use, unitary, cosmetic compact of increased stability, having a base, a hinged cover capable of rotating with respect to the base and an article carrier that is capable of translation and rotation with respect to the base, via a selective rotation mechanism. The combination of a decoupled motion of the article carrier with respect to the base and the fact that the cover and article carrier move independently, creates a versatile, tri-fold compact that may be held in the hand similar to a bi-fold compact or placed on a surface in various useful configurations, including lying flat, extended base and stable A-frame configurations. The compact has an elegant, playful feel, while being versatile, stable, simple and inexpensive to manufacture.

17 Claims, 8 Drawing Sheets

U.S. PATENT DOCUMENTS

| | | | | | |
|---|---|---|---|---|---|
| D145,286 | S | | 7/1946 | Crane | |
| D148,294 | S | | 1/1948 | Gold | |
| 2,485,837 | A | | 10/1949 | Nadelson | |
| 2,512,476 | A | | 6/1950 | Birnkrant et al. | |
| 2,540,304 | A | | 2/1951 | Thomsen | |
| 2,547,971 | A | | 4/1951 | Polin et al. | |
| 2,556,500 | A | | 6/1951 | Levine | |
| 2,678,459 | A | | 5/1954 | Stuckey | |
| 2,983,276 | A | | 5/1961 | Brown | |
| 3,033,258 | A | | 5/1962 | Pollard et al. | |
| D197,368 | S | | 1/1964 | Sydlowski | |
| 3,333,726 | A | * | 8/1967 | Belanger | 220/836 |
| 3,783,999 | A | | 1/1974 | Smith | |
| 4,126,145 | A | | 11/1978 | Boyd | |
| 4,388,935 | A | * | 6/1983 | Napolitane | 132/294 |
| 4,615,461 | A | * | 10/1986 | Liu | 220/815 |
| 4,666,036 | A | * | 5/1987 | Bourbon | 206/45.23 |
| 4,915,527 | A | | 4/1990 | Asano et al. | |
| 5,054,505 | A | | 10/1991 | Yuhara | |
| 5,353,947 | A | * | 10/1994 | Zinnbauer et al. | 220/812 |
| 5,372,249 | A | | 12/1994 | Grange | |
| 5,391,011 | A | | 2/1995 | Gueret | |
| 5,411,134 | A | | 5/1995 | Temple et al. | |
| D360,057 | S | | 7/1995 | Bow | |
| 5,437,294 | A | | 8/1995 | Ebbets, III et al. | |
| 5,568,820 | A | | 10/1996 | Dirksing | |
| 5,605,167 | A | | 2/1997 | Montoli | |
| 5,638,838 | A | | 6/1997 | Lombardi | |
| 5,732,820 | A | | 3/1998 | Tsai | |
| 5,842,486 | A | | 12/1998 | Davis et al. | |
| 5,845,658 | A | | 12/1998 | Sussman | |
| 6,002,651 | A | | 12/1999 | Baccaray | |
| 6,029,848 | A | | 2/2000 | Cha et al. | |
| 6,056,465 | A | | 5/2000 | Kuo | |
| 6,173,838 | B1 | | 1/2001 | Brozell | |
| 6,196,405 | B1 | | 3/2001 | Kambouris | |
| 6,199,559 | B1 | | 3/2001 | Niklaus et al. | |
| 6,200,051 | B1 | | 3/2001 | Gueret | |
| 6,227,208 | B1 | | 5/2001 | Imbert | |
| 6,283,291 | B1 | | 9/2001 | Vasudeva et al. | |
| 6,286,521 | B1 | | 9/2001 | Joulia | |
| 6,412,640 | B1 | | 7/2002 | Destanque et al. | |
| 6,581,774 | B1 | | 6/2003 | Galafassi et al. | |
| 6,769,438 | B2 | | 8/2004 | Fraillon | |
| 7,014,045 | B2 | | 3/2006 | Lin | |
| 7,140,511 | B2 | | 11/2006 | Baker et al. | |
| 2004/0056035 | A1 | | 3/2004 | Baker et al. | |
| 2004/0187885 | A1 | | 9/2004 | Strong et al. | |
| 2004/0221866 | A1 | | 11/2004 | Greenfield | |
| 2005/0199259 | A1 | | 9/2005 | Dumler et al. | |
| 2006/0005853 | A1 | | 1/2006 | Shen | |
| 2006/0226164 | A1 | | 10/2006 | Graham | |

FOREIGN PATENT DOCUMENTS

| | | |
|---|---|---|
| JP | 03047078 | 3/1998 |
| JP | 2005304914 | 11/2005 |
| JP | 2006325923 | 12/2006 |
| KR | 20-0369800 | 12/2004 |
| KR | 20050013279 | 2/2005 |

OTHER PUBLICATIONS

PCT Written Opinion Of the International Searching Authority, Or The Declaration; International Application No. PCT/US07/086799; Completion Date: May 7, 2008; Mailing Date: May 7, 2008.

PCT International Search Report; International Application No. PCT/US2007/078981; Completion Date: Feb. 13, 2008; Date of Mailing: Feb. 13, 2008.

PCT Written Opinion Of the International Searching Authority, Or The Declaration; International Application No. PCT/US2007/078981; Completion Date: Feb. 13, 2008; Mailing Date: Feb. 13, 2008.

* cited by examiner

VERSATILE, TRI-FOLD COMPACT WITH DECOUPLED MOTION

FIELD OF THE INVENTION

The present invention relates to a container for packaging or convenient storage of various articles. Specifically, the implementation herein described is a tri-fold compact, featuring a selective rotation mechanism. For purposes of illustration, the container described is implemented as a compact for personal care articles, such as cosmetic or dermatologic products and ancillary items, such as mirrors, brushes and other applicators. It should be understood, however, that the principles of the invention are not limited to cosmetic compacts, and may find implementations in other areas of packaging and storage.

BACKGROUND

Compacts are versatile in that they are convenient, functional and secure while also being visually appealing. The latter is an important feature in a retail environment. Cosmetic compacts are dimensioned to be held in one hand during use, and may be square, rectangular, oval, circular, or other regular or irregular shape. For illustration purposes, we embody the present invention as a type of compact wherein the width and depth of the compact are larger than the height of the compact. This type of cosmetic compact is relatively flat and planar, and easy to describe in terms of the current invention. Compacts of interest in this specification, generally comprise a base member and a cover member, that are capable of orienting with respect to each other, via a hinge or pivot mechanism. Without lose of generality, throughout the specification, "hinge" will refer to any type of connection that facilitates a relative rotation between members of the compact. Typically, the base and cover are molded of one or more plastics or formed of metal for a more upscale presentation, for example.

Bi-Fold Compacts

Throughout the specification, "bi-fold compact" refers to a compact having exactly two members that are capable of rotating with respect to each other, via a common hinge. A bi-fold compact typically includes a base member formed as a tray. The tray has one or more recesses and that is capable of holding one or more cosmetic materials. Also, the typical bi-fold includes a cover member hinged to the base member and overlaying the base member and cosmetic material. The cover reduces the occurrence of cosmetic dry-out, contamination or spill. Compacts of this type are suitable for storing powders, foundations, eye shadows, blushes, mascara, lip makeup and other products. One or more applicators or ancillary items may also be placed in the compact, between the base and cover. When the base-to-cover attachment is a hinge that has an elongated pin or axis, then the base and cover are attached along a straight edge that forms a portion of one side of the of the compact. On a side of the compact without the hinge (for example, the side opposite the hinge), a latch mechanism is sometimes provided to prevent the compact from opening inadvertently. The range of motion of the cover relative to the base is generally from 90° to 360°, although special hinge mechanisms are generally required for rotations approaching 270°. Bi-fold compacts that rotate at least 180°, may lie flat, which is sometimes an advantage, where stability is a factor. For example, sometimes an opened compact is top-heavy and the base placed on a surface will not lay flat when the cover is rotated beyond some tipping point. In this case, it may be convenient to "unfold" the compact and cause it to lie flat. Compacts which cannot lie flat on a surface, may therefore, be disadvantaged.

In a bi-fold compact, a mirror is often provided within the inwardly facing surface of the cover, so as to be visible by a user when the compact is open. A mirror, thus located in the cover, gives the user the option of holding the compact and mirror in one hand, while manipulating an applicator in the other hand, as opposed to placing the compact on a surface. This is a significant convenience for the user, because if a separate handheld mirror is used, then the user has three items to manipulate with only two hands. It is also advantageous that the mirror can rotate with respect to the base, so that an optimal configuration can be achieved for manual manipulation. One disadvantage of the mirror-in-cover arrangement is that, even when the cover is see-through, the interior of the compact cannot be viewed, because the mirror is in the way. Also, oftentimes, a user wants to use the mirror, but not the product. When the mirror is mounted in the cover, the cover must remain opened and the product exposed, subjecting it to dry-out, contamination or inadvertent contact. Therefore, mirrors mounted in the cover member of a compact are further disadvantageous.

To overcome these mirror-in-cover disadvantages, some bi-fold compacts comprise a third member that is capable of sliding with respect to the base member and/or cover member. For example, US patent 2004-0221866 discloses a bi-fold compact having a "drawer" slidably supported inside a base. The drawer can translate toward the inside and toward the outside of the base, but cannot rotate with respect to the base. A mirror is disposed in the drawer, rather than the inside of the cover, which has the advantage of permitting a see-through cover and allowing the mirror to be used even when the cover is closed, but the disadvantage of not being able to rotate the mirror with respect to the base. A slide-out member may provide an advantage in stability of the compact. As noted above, some compacts tip over when the cover is rotated beyond a tipping point. But a drawer or tray that slides out from the base, provides an effectively larger base and may prevent the compact from tipping. Thus, compacts without slide-out members in the base may provide an advantage in the design of the compact.

To overcome the see-through problem, while still having the mirror mounted in the cover, U.S. Pat. No. 6,769,438 describes a bi-fold compact having a mirror that is slidably mounted inside the cover. The sliding mirror is in one position prior to sale (allowing a view through a window in the cover) and is moved to another position by the purchaser, prior to use. While this compact has a see-through cover (at least some of the time) mirrors mounted in the cover member of a compact can be disadvantageous. As discussed above, oftentimes, a user wants to use the mirror, but not the product. If the mirror is mounted in the cover, then the cover must remain opened and the product exposed.

Tri-Fold Compacts

Cosmetic compacts with three pivoting members are also known. With three members, and one or two hinges, various configurations are possible.

For example, one class of tri-fold compact has three members that pivot with respect to each other, via two hinges. In this case, we can define a base member and two outer members. The base member has two hinges separated along different portions of its perimeter. Each separate hinge connects the center member to one of the outer members. Examples of this kind of compact are disclosed in U.S. Pat. No. 6,029,848 (FIG. 10) and U.S. Pat. No. 6,412,640. One feature of this kind of arrangement is that the compact may lie flat (all three members lying flat, in the same plane, simultaneously), when both outer members are sufficiently rotated away from their closed positions. As discussed above, the ability of a compact to lie flat can be advantageous and compacts which cannot lie flat on a surface, may be disadvantaged.

In another form of tri-fold compact, any two members are hinged to a third member along the same edge of the third member, such that, the compact opens and closes like a book. (See, for example, U.S. Pat. Nos. 4,126,145; 5,107,871; US2006-0005853 and US2006-022164). This type of tri-fold compact cannot be made to lay flat, as defined above and, therefore, is disadvantaged. The cover member may be see-through, but this only affords a view of the member immediately adjacent the cover, which is not always the product. When the product is in the member further from the cover, the product would not be visible, even with a see-through cover, because of the intervening member. This is the case in the '145, '871 and '853 references. In the '164 reference, the product is adjacent the cover, but a mirror is positioned on the inside of the cover member, thereby negating a see-through cover. Also, here again, if a user wants to use the mirror, but not the product, the cover must remain opened and the product exposed, subjecting it to dry-out, contamination or inadvertent contact. In compacts of this type, the first two members cannot move completely independently of each other, because the rotate in the same path. This may limit the number of useful configurations that a compact may assume.

Packaging Issues

Cosmetic compacts, whether bi-fold or tri-fold, are sometimes packaged in a manner that allows customers to view the contained cosmetic material, without exposing the material to contamination. Accordingly, the compact may be sealed in a transparent plastic film, e.g., in a blister package, with the cover opened and rotated 180° with respect to the base, so that the base an cover lie flat. A problem with this type of packaging, however, is that the volume of the packaging is ordinarily about twice as large as it otherwise would be. This increases the expense of packaging, increases waste and consumes shelf space. Also, the blister pack can significantly detract from the visual presentation of the product.

One method of alleviating this problem is to package the compact in a closed configuration and provide a means for viewing the cosmetic material through the closed cover, either with a window or by making the cover transparent. Methods of doing this and their advantages and disadvantages were discussed above.

Another method of reducing the size of blister packaging is to provide the compact with a special articulated hinge that enables the cover to rotate 360°, into a position underlying the base. (See, for example, U.S. Pat. No. 5,568,820.) However, such hinges tend to be more structurally complex and more expensive to implement than conventional hinges. The 360° hinge may also be less stable during use, because the cover in the opened position does not rest against a stop, as it does when more conventional hinges are used.

It is also known to make compacts with completely removable trays (for example, U.S. Pat. Nos. 5,605,167 and 6,002,651), hermetic seals (for example, U.S. Pat. Nos. 5,842,486 and 6,199,559), transparent covers or covers with windows or lenses (for example, U.S. Pat. Nos. 6,227,208; 6,769,438 and 2004/0221866), snap-off covers to prevent breakage if rotated too far (for example, U.S. Pat. No. 5,638,838), and interior lighting (for example, U.S. Pat. No. 4,126,145). Compacts according to the present invention may be equipped with any of these features.

Of the references cited above, no one reference nor any combination thereof discloses a single cosmetic compact that features all of the following: a base, a hinged cover capable of rotating with respect to the base; a mirror that is capable of translation and rotation with respect to the base, via a selective rotation mechanism; a cover that is fully see-through or any portion thereof; a mirror whose size is not affected by the see-through cover and whose position does not depend on the position of the cover; a compact in which the mirror or cover can be kept out of way when not needed, i.e. the mirror can be used while the cover is closed and the product not exposed; a compact that can be conveniently held in the hand during use or placed on a surface; a compact that can achieve a stable, useful A-frame configuration (see below) or can lie flat; a compact that can extend the base for added stability to reduce the likelihood of tipping; a compact wherein stored auxiliary items are visible or hidden; a compact which can be sold in a blister-type package without the disadvantages discussed above.

SUMMARY OF THE INVENTION

The present invention is a versatile, convenient-to-use, unitary, cosmetic compact of increased stability, comprising a base, a hinged cover capable of rotating with respect to the base and an article carrier that is capable of translation and rotation with respect to the base, via a selective rotation mechanism. The cover and article carrier move independently of each other. A compact according to the present invention may be held in the hand similar to a bi-fold compact or the compact may be placed on a surface in various useful configurations, including extended base and stable A-frame configurations.

A selective rotation mechanism has the following features. With respect to the base, the article carrier is sometimes capable of translational movement and sometimes capable of rotational movement, but the carrier can only perform one type of motion at a time. Furthermore, the user does not have a choice, in that, the type of movement (translation or rotation) that the carrier may execute is dictated by the relative orientation of the carrier and base. There is one exception to this rule. There is exactly one orientation of the carrier with respect to the base from which the user has a choice to execute either translation or rotation, but not both simultaneously. Once the article carrier has rotated away from a co-planar orientation with respect to the base, the carrier is no longer capable of translation. Put another way, compound movement of the carrier, with respect to the base, is not possible. "Compound movement" means two or more types of motion occurring simultaneously, i.e. translation and rotation.

DESCRIPTION OF THE DRAWINGS

In FIG. 2*a,* the base is holding multiple powder pans.

DETAILED DESCRIPTION

Figure 1:
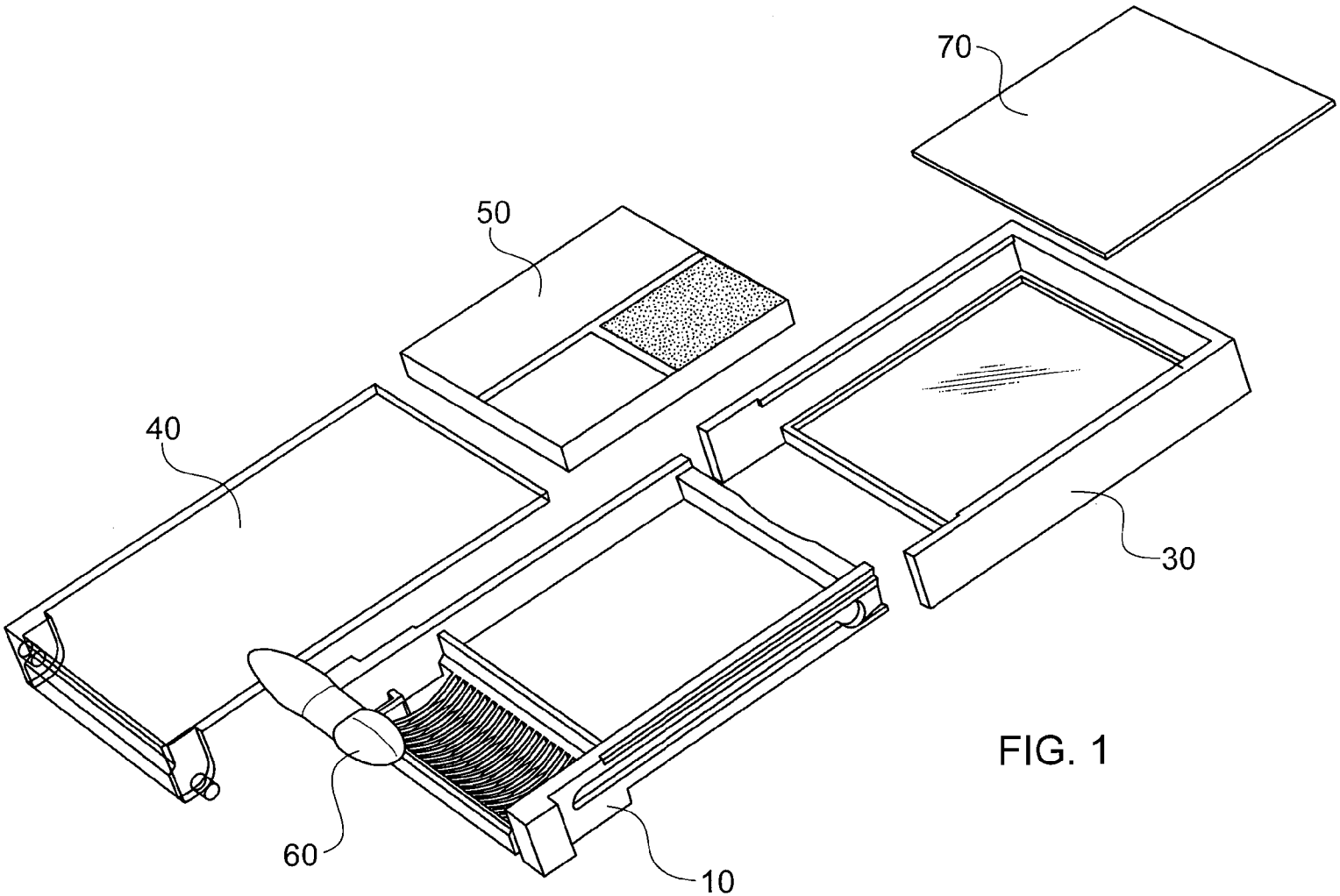
FIG. 1 is an exploded, perspective view of a cosmetic compact according to the present invention.

Throughout this specification, the terms "comprise," "comprises," "comprising" and the like shall consistently mean that a collection of objects is not limited to those objects specifically recited.

"Unitary compact" or the like, means that the components of the claimed invention are connected, at all times, during use. The connections between the components restrict the degrees of freedom of the components, with respect to one another. So, for example, a compact and a mirror that are separated during use, do not form a unitary compact.

"Translation" and related grammatical forms refer to linear motion of an element, apart from rotation of the element. "Rotation" and related grammatical forms refer to motion of an element about a physical pivot, apart from translation of the element.

For purposes of example only, the drawings show a unitary, cosmetic compact of the low-profile or flat, planar type, whose height is significantly smaller than its width and depth. Such compacts are often used to house pressed powders in metal or plastic pans and may provide storage for ancillary items, such as an applicator or mirror. However, the principles disclosed herein are applicable to other types of compact containers, including those where the height is comparable to or greater than the width or depth.

It is a convenient feature of the present invention that the article carrier (30) and cover (40) move independently of each other, creating a tri-fold effect. Thus, the cover may be opened while the article carrier is in any position and vice versa. For easy reference, we define a number of configurations.

1. Lying Flat—When the opened cover (40), base (10) and fully extended article carrier (30) lie in the same plane, then the compact is lying flat. Note that in the embodiment of FIG. 7*c,* the cover is lying flat, but the base is slightly raised on one end due to the cover rotating underneath the base. Despite a slight raising of the base, we still refer to the cover and base as lying flat, in the same plane. It is easy to imagine different embodiments of the cover that eliminate any slight raising of the base. We can also refer to the opened cover and base as lying flat or the fully extended article carrier and base as lying flat, whenever only two parts of the compact lie in the same plane.

2. 90° Configuration—A 90° configuration is when the article carrier (30) is rotated upward with respect to the base (10), at a right angle to the base.

3. 270° Configuration—A 270° configuration is when the article carrier (30) is rotated downward with respect to the base (10), at a right angle to the base.

4. Extended Base—The cover (40) and base (10) lie flat, while the article carrier (30) is rotated upwards toward a 900 configuration. In this position the cover effectively extends the base and may prevent the compact from tipping under the weight of the article carrier.

5. Stable A-Frame Configuration—An "A-frame configuration" is where the base (10) and article carrier (30) are positioned relative to each other, at an angle of at least about 270°. A "stable A-frame configuration" is when the compact can stand up on a surface, without falling down, with the apex of the A-frame superior to the sides (or legs) of the A-frame. For example, to prevent the A-frame from collapsing under its own weight or as a result of external force, the base and carrier may be locked in position. A stable A-frame configuration is useful as a stand. A compact that does not have a lock mechanism, or is otherwise unstable, may not hold the A-frame configuration for a useful period of time. The compact of the present invention is capable of holding a A-frame configuration for a useful period of time. Compacts that are not flat or planar, like US 2006-0005853 for example, are much less suited for stable A-frame configuration.

The Base

Figure 2A:
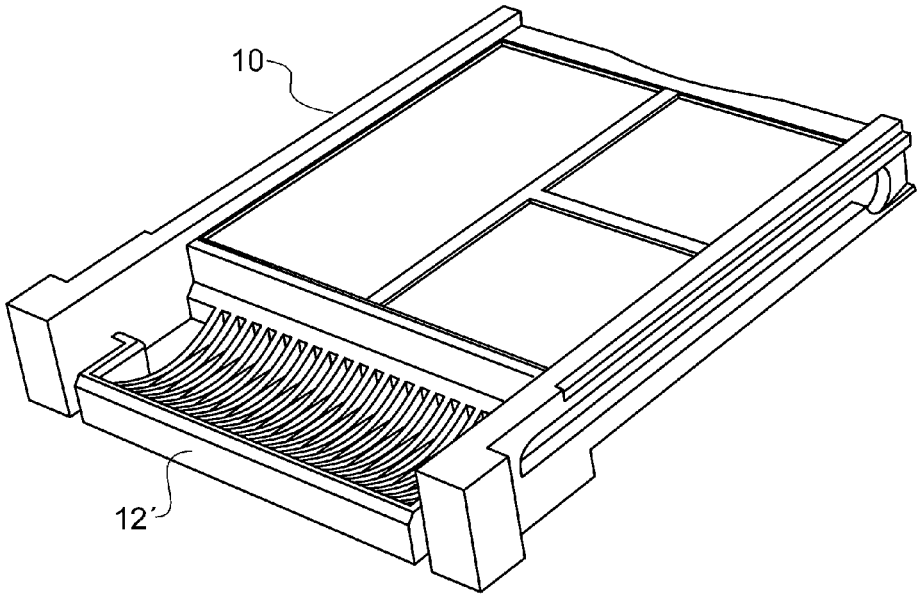
FIGS. 2*a* and 2*b* are perspective views of a base member of a cosmetic compact according to the present invention.
Figure 2B:
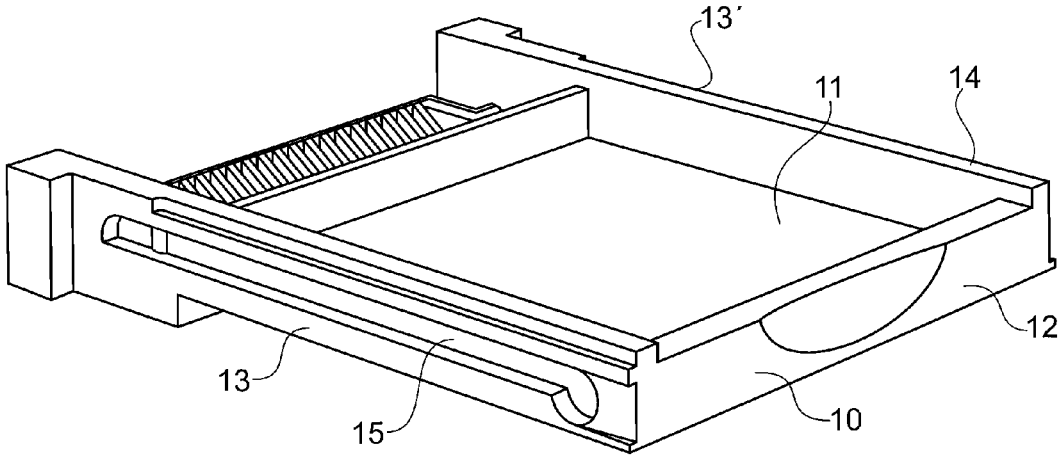

Referring to FIGS. 1, 2*a* and 2*b,* the base (10) is, generally, the largest or main component of the compact. Though shown in an essentially rectangular shape, the principles of the present invention may be manifested in a base that is very different from rectangular. In the embodiment of FIGS. 2*a* and 2*b*, the base has a bottom wall (11), front and back walls (12,12') and two lateral walls (13,13'). It is convenient to refer to the horizontal dimension associated with the front and/or back walls as the width of the compact. Likewise, the horizontal dimension associated with the lateral walls will be referred to as the depth of the compact. The top (14) of the base is opened to receive one or more cosmetic or dermatological articles and/or preparations. The interior of the base may be divided into sections. In FIG. 1, there is a section for receiving a powder pan (50) and a section for holding an applicator (60). The number of sections is limited by the size of the articles housed in the compact overall dimensions of the compact.

The base is provided with one or more grooves (15) that extend along one or more walls of the base. In the following description, one groove is depicted as running along each lateral wall (13, 13') of the base. The grooves may or may not pass completely through the lateral walls of the base. The base will ordinarily be fashioned from one or more plastics, by any conventional means.

From FIG. 1, it should be clear that the relative dimensions of the compact do not significantly limit the implementation of the present invention. In cosmetic compacts, the width and/or depth commonly vary from at least as low as 30 mm to 150 mm and maybe more. The height of the compact commonly varies from a low of about 15 mm or maybe even less. There is some practical lower limit on the height of the lateral walls (13, 13') of the base (10) because these walls must be high enough to accommodate grooves (15). In research, compacts according to the present invention, whose lateral walls have a height as small as three quarters of a centimeter have been constructed with no undue difficulty. It is clear that the lateral walls of the base may be shorter than three quarters of a centimeter, although at some point, the device will become too small for a user to conveniently handle. Therefore, as a practical matter, approximately one half centimeter is a lower limit for the height of the lateral walls of the base or a lower limit for the height of that feature which embodies the grooves. Furthermore, one quarter centimeter is an approximate lower limit of the height of the grooves.

The Article Carrier

Figure 3:
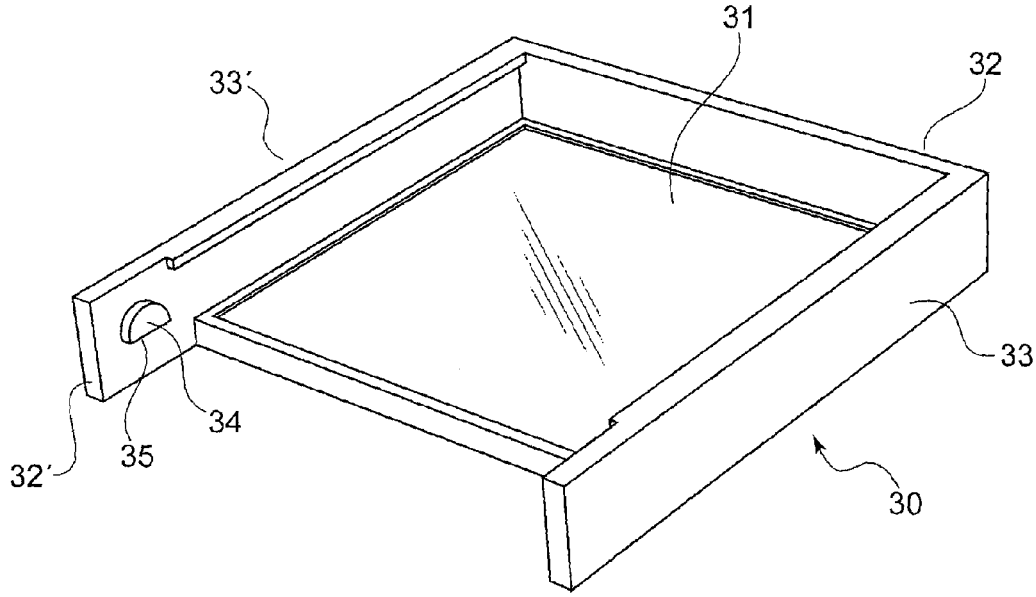
FIG. 3 is a perspective view of an article carrier of a cosmetic compact according to the present invention.

In FIG. 3, the article carrier (30) is a receptacle for an article that is being housed in the compact. The article carrier may act as a receptacle that is capable of accepting and retaining a cosmetic article; for example, a mirror may be glued to the bottom of the article carrier. The article carrier may be any suitable construction capable of securely holding a cosmetic article. "Securely holding" means that the article is retained in the article carrier during normal use and that the article carrier has been adapted to secure the article by employing means known to a person of skill in the art of compact devices. Furthermore, the article carrier may act as a receptacle that is capable of storing a cosmetic article, which article can be removed from the carrier by a user. For example, an applicator may be housed in the article carrier. The carrier may ordinarily be fashioned from one or more plastics, by any conventional means. In the embodiment of FIG. 3, the carrier is not unlike a box, having a bottom (31), a front wall (32) and lateral walls (33, 33'). The back wall (32') of the article carrier is opened to receive a portion of the base (10).

Figure 5A:
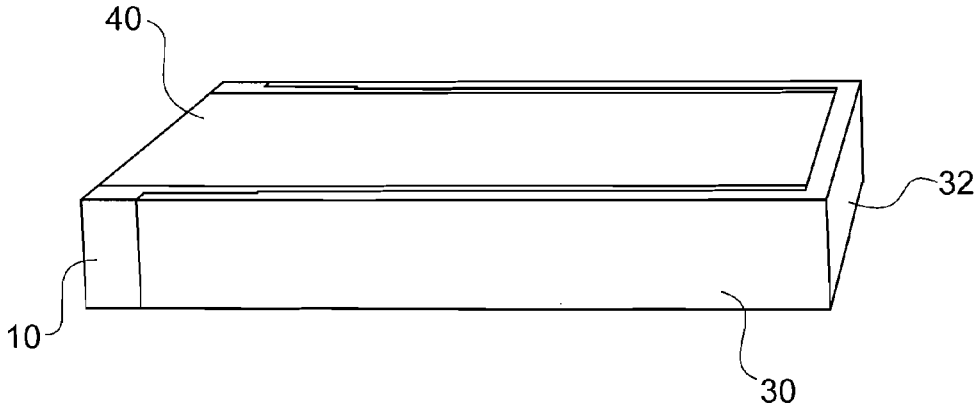
FIG. 5*a* is a schematic representation of a cosmetic compact according to the present invention, in the closed position.
Figure 5B:
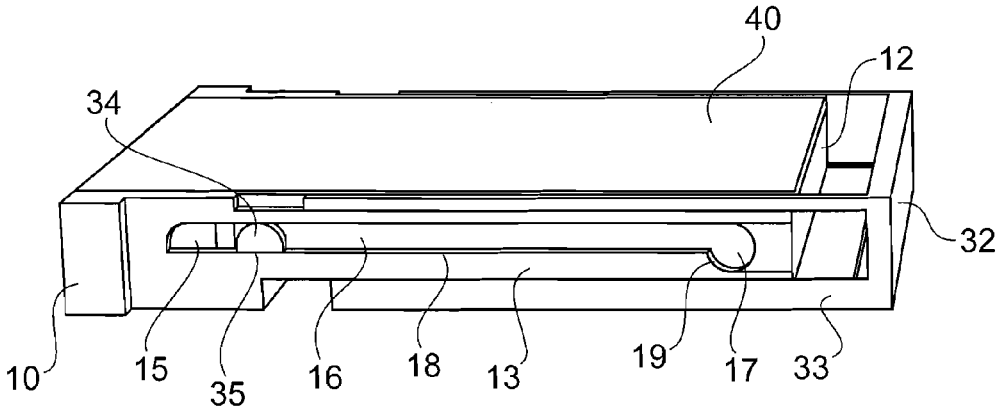
FIG. 5*b* is a schematic representation of a cosmetic compact according to the present invention, in a partially translated position, with a section of the article carrier removed, to expose the groove and pivot interface. Each article carrier pivot has one straight edge.

In FIG. 5*b*, a portion of one lateral wall (33) of the article carrier (30) is removed to show the connection underneath. The base (10) fits within the article carrier, being received through the back wall (32') of the carrier. The article carrier is sometimes capable of sliding (translating) horizontally with respect to the base. When translating, the lateral walls (33, 33') of the article carrier slide over the lateral walls (13, 13') of the base, and the inner surface of the bottom (31) of the article carrier slides over the outer surface of the bottom (11) of the base. Preferably, the interior of the article carrier is shaped complementarily to the exterior of that portion of the base over which it slides. This close fit will limit unwanted movement of the article carrier with respect to the base.

The article carrier (30) slides between a fully retracted position (FIG. 5*a*), where the front (32) of the carrier is closest to the front (12) of the base (10), and a fully extended position, where the front of the carrier is farthest from the front of the base. When the article carrier translates to an extended position, one or more cosmetic articles in the article carrier, are exposed, previously being hidden under the base.

Figure 5C:
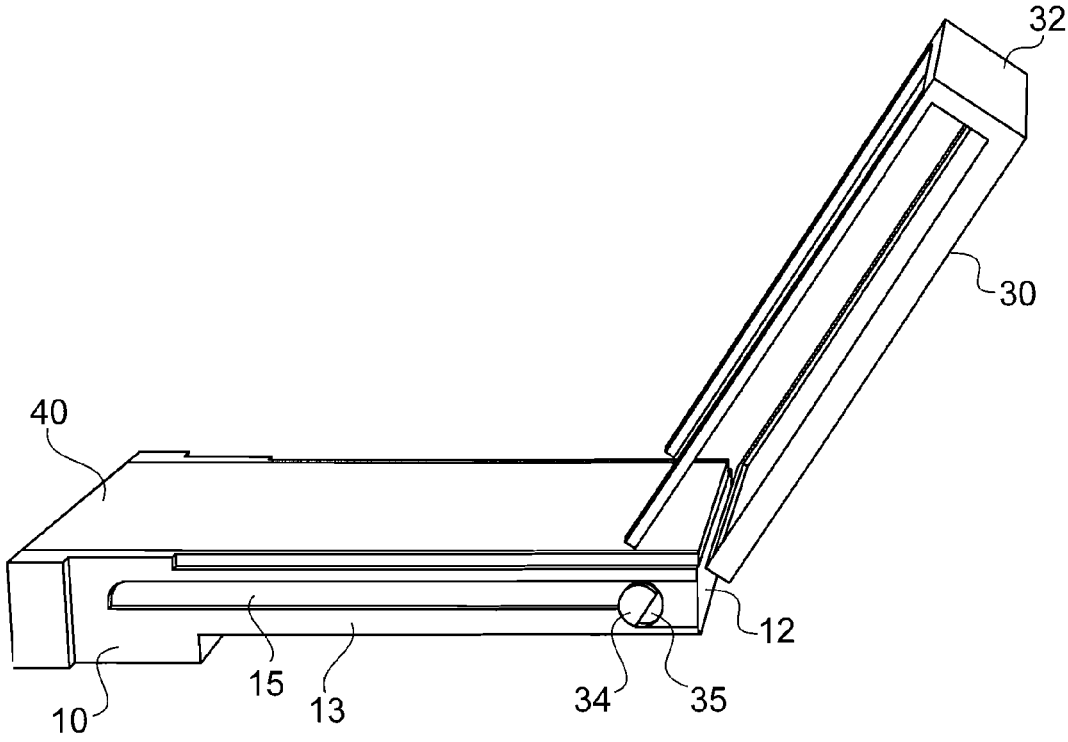
FIG. 5*c* is a schematic representation of a cosmetic compact according to the present invention, in a fully translated and partially rotated position, with a section of the article carrier removed, to expose the groove and pivot interface. Each article carrier pivot has one straight edge.
Figure 6A:
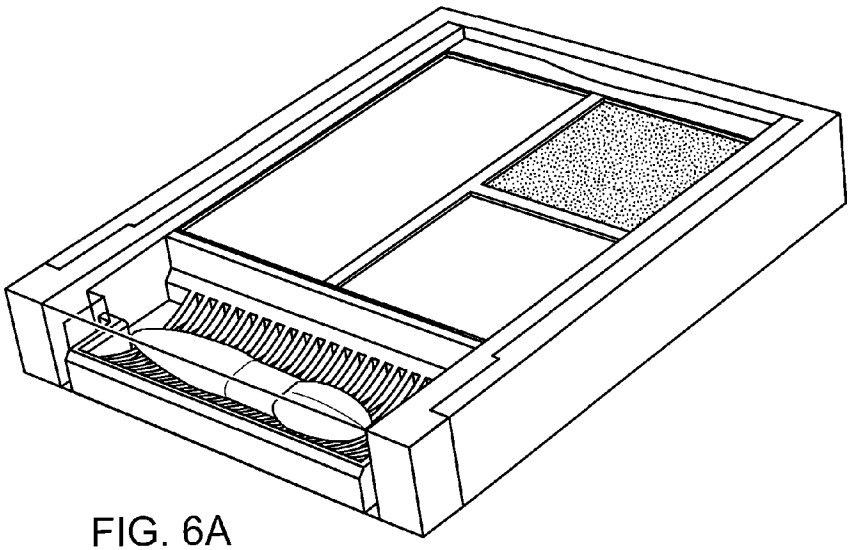
FIG. 6*a* is a top perspective view of a cosmetic compact according to the present invention, in the closed position.
Figure 6B:
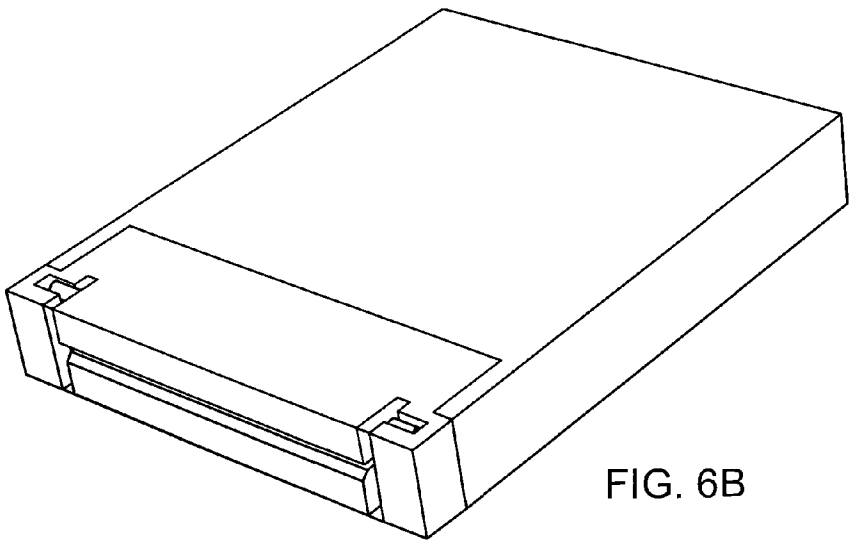
FIG. 6*b* is a bottom perspective view of a cosmetic compact according to the present invention, in the closed position.

When the article carrier (30) is in a position like that shown in FIGS. 5*a* or 5*b*, we refer to the carrier as being "horizontal" and/or not rotated with respect to the base (10). In contrast, FIG. 5*c* shows an article carrier that is rotated with respect to the base, i.e. not horizontal.

Each lateral wall (33, 33') of the carrier (30) is provided with a sliding and pivoting attachment to the base (10). The attachment is effected through the grooves (15) provided in the lateral walls (13, 13') of the base. The attachment may be, for example, pivot elements (34, 34') extending from the inner surface of the lateral walls of the article carrier, into the grooves, where the pivot elements will ordinarily remain during normal use of the compact. The connection is such that sometimes the carrier can translate with respect to the base and sometimes the carrier can rotate with respect to the base, but both motions cannot occur simultaneously. In fact, the article carrier can rotate, only when the pivots are at their full horizontal extent. If the pivots are at less than their full horizontal extent, then the carrier is prevented from rotating. Specific examples for accomplishing this are described, below. The examples concern the geometry of the grooves and the geometry of the attachments (i.e. pivots) that travel in the grooves. However, the general principle involved in the present invention is any selective rotation mechanism, where "selective rotation mechanism" is defined as an arrangement that satisfies the following three requirements:

1. a selective rotation mechanism prevents rotation of the article carrier (30) when the pivots (34, 34') are at less than their full horizontal extent;

2. a selective rotation mechanism allows rotation of the carrier when the pivots are at their full horizontal extent;

3. a selective rotation mechanism permits translation of the carrier only when the carrier is horizontal (that is, not rotated with respect to the base).

Stated more concisely, a selective rotation mechanism only allows rotation of the carrier (30) when the carrier is fully extended with respect to the base, and only permits translation of the carrier when the carrier is not rotated with respect to the base. Taken together, these requirements also mean that the carrier cannot translate and rotate simultaneously. We say, the carrier cannot perform a compound motion or equivalently, the motion of the carrier is decoupled. Thus, there is only one configuration of the base and article carrier from which both rotation and translation of the article carrier (30) may occur. By "only one configuration" I mean to exclude slight variations of the configuration that arise due to some play in the fit of the components. Maintaining routine tolerances in the art of plastic component manufacture will ensure that the spirit of this invention is followed. Tighter tolerances may only add slight improvement. Selective rotation mechanisms meeting these requirements were described in applicant's co-pending application, U.S. Ser. No. 11/537,210, herein incorporated by reference, in its entirety.

The Base Cover

Figure 4:
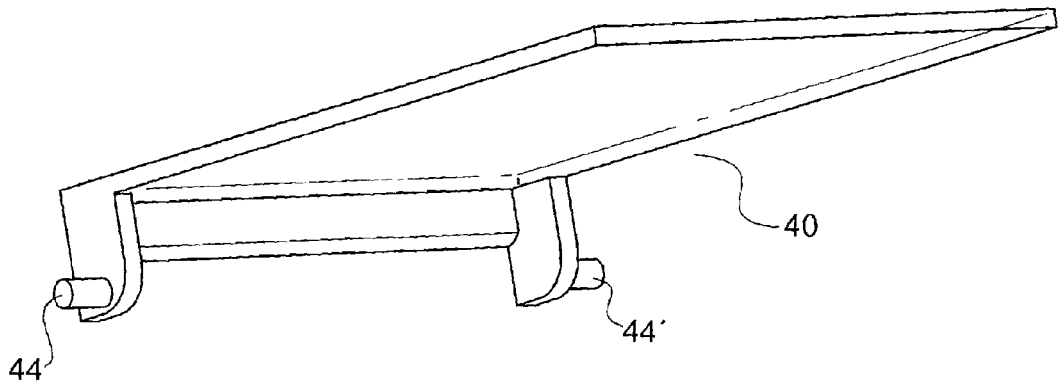
FIG. 4 is a perspective view of a base cover of a cosmetic compact according to the present invention.

A base cover (40) according to the present invention, is shown in FIG. 4. The cover is pivotally attached to the base, preferably near the back wall (12') of the base, where it will not interfere with the movement or use of the article carrier. In the closed position, the cover lays on top of the base or perhaps, just inside the top of the base. In this position, the cover protects the contents of the base. The cover may generally be flat and, preferably, at least a portion of the cover is see-through, most preferably, transparent. While neither of these features is a rigid requirement, a see-through cover is a great advantage in that a consumer may see the contents of the compact without opening the compact. For example, a cosmetics consumer will be able to see the color of one or more cosmetic preparations contained within the compact. If the cover was not see-through, then some other means would have to be provided for letting the consumer see the color of the cosmetic. Often, to allow the cosmetics consumer to see what she is buying, a "floor sample" will have to be provided. Considering, that one sample of each color or variation would have to be provided, the transparent cover of the present invention represents a unit savings and a savings of counter space needed to display the samples. The entire cover may or may not be see-through, as long as a consumer can see the important features within the base. For example, a portion of the cover may display a decorative or informational feature. The cover will ordinarily be fashioned from one or more plastics, by any conventional means.

Figure 7A:
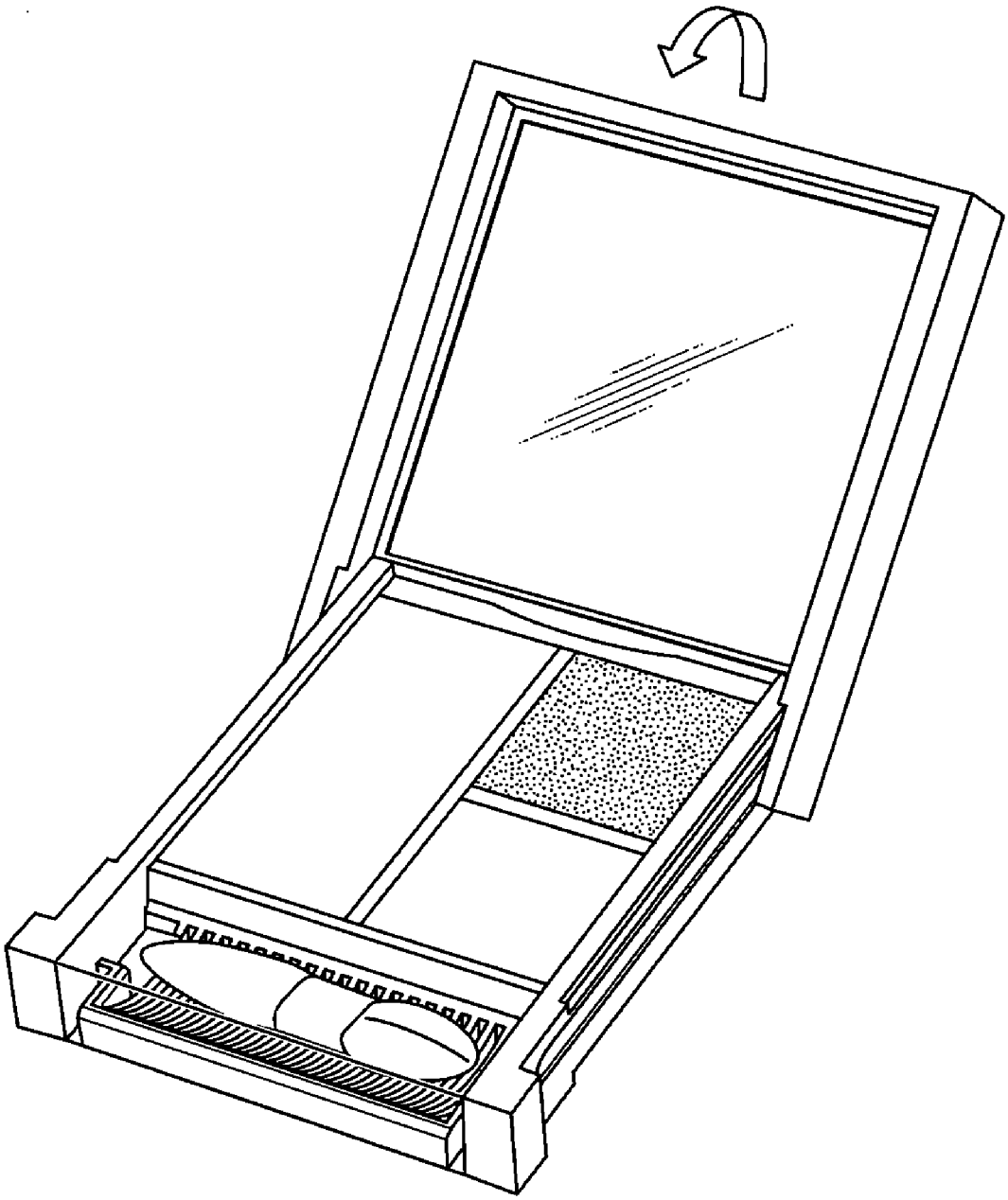
FIG. 7*a* is a perspective view of a cosmetic compact according to the present invention, with the article carrier in an opened position and the base cover in the closed position.
Figures 7B, 7C:
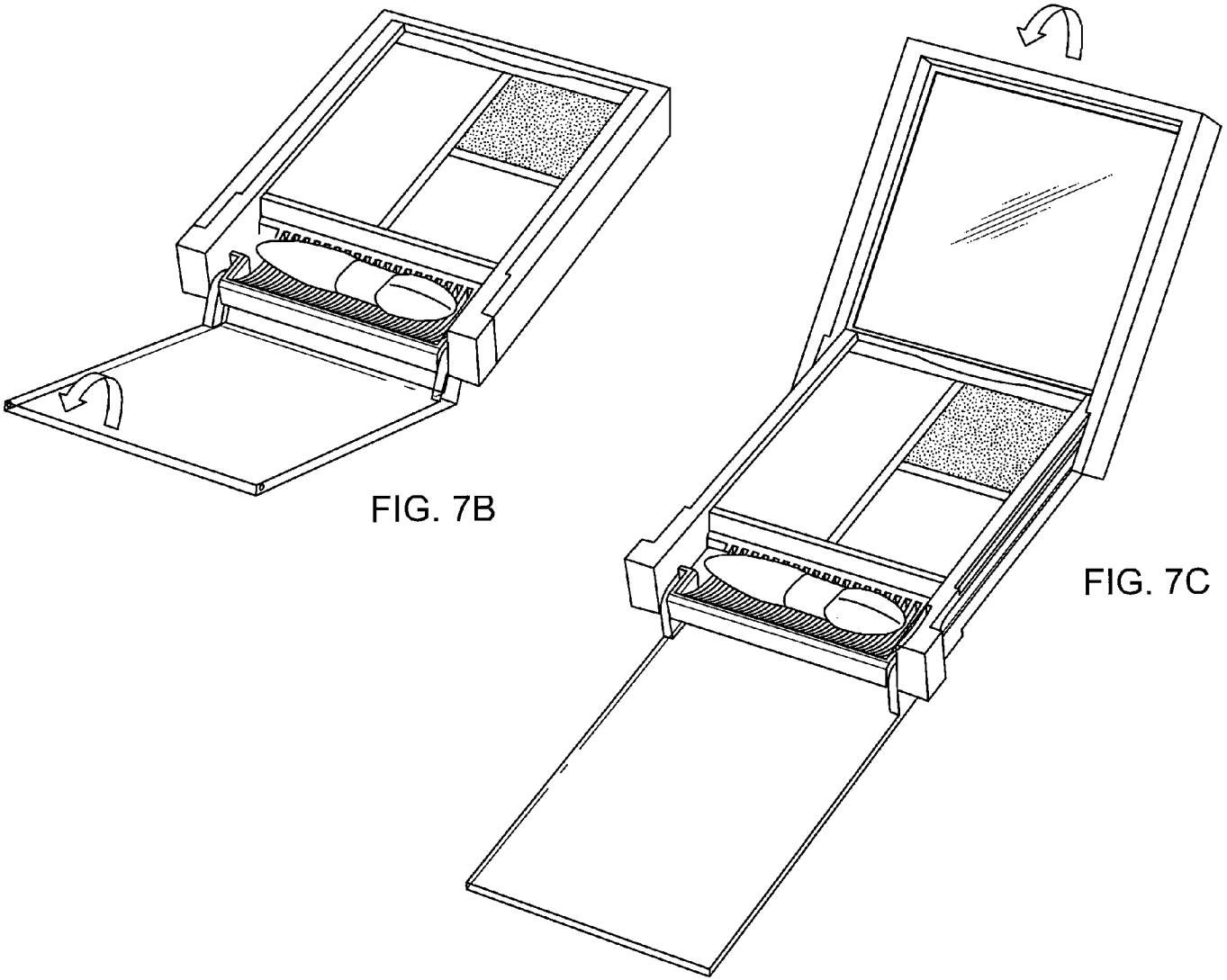
FIG. 7*b* is a perspective view of a cosmetic compact according to the present invention, with the article carrier in the closed position and the base cover in an opened position.
FIG. 7*c* is a perspective view of a cosmetic compact according to the present invention, with the article carrier and the base cover in opened positions.

Preferably, the pivoting attachment of the cover (40) to the base (10) allows the cover to rotate at least 90° with respect to the base, more preferably, at least 180° so that the cover can lie flat, in the same plane as the base (see FIG. 7*c*). The attachment may be one or more pivots (44, 44'), depending from either side of the cover to be received into complementary slots in the base. The pivot and slot configuration may feature a snap fitting engagement or any means that discourages the pivots from coming out of the slots. Many equivalent means will be apparent to a person skilled in the art. Unlike the article carrier (30), the cover is not generally capable of translation with respect to the base. The cover is merely rotated off of the base to provide access to the interior of the base.

As thus described, the cover and article carrier (30) rotate about pivots located near opposite ends of the base. Preferably, the axes of rotation of the cover and article carrier are sufficiently separated so that each is able to move independently of the other. Independently of the other means that the path of the cover and article carrier do not intersect or otherwise influence each other. The cover may be closed while the article carrier is in any position and vice versa. The cover and article carrier are always capable of moving simultaneously or one at a time. This is not the case in many prior-art tri-fold compacts, particularly of the book type, wherein the position of one pivoting member may interfere with the movement of another pivoting member.

The Selective Rotation Mechanism

In one embodiment (see FIGS. 5*b*, 5*c*), the base (10) comprises at least one groove. Preferably, the base comprises two grooves (15, 15'), one on each lateral wall (13, 13') of the base. Each groove is in two sections. One section is a relatively long, straight groove (16) that runs horizontally, along a lateral wall of the base. Approaching the front (12) of the base, the straight groove opens into a circular groove (17). The circular groove has a diameter that is larger then the height of the straight groove. The entire groove is defined by a groove wall that bounds the groove. The straight groove is bounded on both sides by straight, parallel sections (18) of the groove wall. The circular groove is bounded by a circular section (19) of the groove wall. The center line of the straight groove (16) is offset from the center of the circular groove (19). In fact, one wall of the straight groove is shown in FIGS. 5*b* and 5*c* as being tangent to the circular groove. Thus, the center line of the straight groove does not pass through the center of circular groove. The pivots (34, 34') of the article carrier travel along the grooves (15, 15'), such that the path of the center of the each pivot is offset from the center of the circular groove.

Associated with each pivot (34, 34') are one or more straight edges. Thus, for example, each pivot may be a truncated cylinder (as shown in FIGS. 5*b* and 5*c*). During translation of the article carrier, each straight edge (35) travels within a straight groove (16), wherein it has close contact with the groove wall (18). When the pivot elements are in the straight groove, the straight edges are parallel to the walls of the straight groove. Also, the straight edges are longer than the height of the straight groove, such that the abutment of the straight edges against the groove walls prevents appreciable downward rotation of the article carrier (30). Of course, as is clear from FIG. 5*b*, upward rotation of the article carrier is also impossible due to the carrier bottom (31) abutting the base bottom (11). Thus, when the straight edges are outside of the circular groove (17), the article carrier is capable of translation with respect to the base (10), but not rotation. However, downward rotation of the article carrier is prevented only by the straight edge abutting the wall (18) of the straight groove (16).

Furthermore, the straight edges (35) are shorter than the diameter of the circular groove (17). Thus, once the straight edges have entered the circular groove, the article carrier (30) is capable of rotation. Once the article carrier has rotated away from horizontal, the same straight edges cannot reenter the straight groove (16), because the straight edges are longer than the height of the straight groove. This prevents the article carrier from translating.

Thus, when the pivots (34) are at less than their full horizontal extent, the straight edges (35) allow translation of the article carrier (30), but prevent rotation of the article carrier. Furthermore, when the pivots are at their full horizontal extent, the straight edges allow rotation of the article carrier, but prevent translation, except when the article carrier is horizontal. Only when the article carrier is horizontal, does the user have a choice of how to move the article carrier (translation or rotation). However, only one motion is possible at a time. This combination of features imparts stability and convenience, while being simple to implement and unlike anything in the prior art.

Alternate embodiments of a selective rotation mechanism are described in applicant's co-pending application, U.S. Ser. No. 11/537,210. For example, an alternate implementation of the article carrier pivot is one or more straight ridges rising from the inner surface of the article carrier. In this embodiment, the pivots actually have no rounded portion. Each straight ridge travels within a straight groove (16), wherein it has close contact with the groove wall (18). The straight ridges are parallel to the groove wall and longer than the height of the straight grooves. This length is sufficient, such that the abutment of the straight ridges against the groove walls prevents appreciable downward rotation of the article carrier (30). Thus, when the straight ridges are outside of the circular groove (17), the article carrier is capable of translation with respect to the base (10), but not rotation.

Furthermore, the length of the straight ridges is less than the diameter of the circular groove (17), so that, once the straight ridges have entered the circular groove, the article carrier (30) is capable of rotating. Once the article carrier has rotated away from horizontal, the same straight ridges cannot reenter the straight groove (16), because the straight edges are longer than the height of the straight groove. This prevents the article carrier from translating.

Thus, when the straight ridges are at less than their full horizontal extent, the straight ridges allow translation of the article carrier (30), but prevent rotation of the article carrier. Furthermore, when the straight ridges are at their full horizontal extent, the straight ridges allow rotation of the article carrier, but prevent translation, except when the article carrier is horizontal. Only when the article carrier is horizontal, does the user have a choice of how to move the article carrier (translation or rotation). However, only one motion is possible at a time. This combination of features imparts stability and convenience, while being simple to implement and unlike anything in the prior art.

While either embodiment is effective, the truncated cylinder embodiment of the pivot (34) may be preferred to the straight ridges, because the cylinder, as shown in FIG. 3, may be stronger than a thin ridge and provide superior resistance to wear and tear. In either case, when the straight edges are below the circular groove (17), the article carrier is capable of translation with respect to the base (10), but not rotation.

Regardless of the embodiment of the selective rotation mechanism, once the straight edges have entered the circular groove, the article carrier (30) is capable of rotating. In particular, the article carrier may rotate either up or down. Regarding upward or downward rotation, there may be no need to provide for more than about 90° of arc, in either direction, but this is optional. When the article carrier is fully extended, but not rotated, we say the carrier and base are positioned or rotated at 180° relative to each other, or are lying flat. When the carrier rotates upward, we say the carrier and base move toward a 90° configuration and when the carrier moves downward, we say the carrier and base move toward a 270° configuration. Preferably, once the carrier and base are rotated with respect to each other, the compact is able to maintain the rotated configuration, without moving under the weight of the compact. For example, snap or friction fit engagements or other locking mechanism may be provided to hold the rotated alignment.

When the article carrier is rotated upward, then the inner surface of the bottom of the article carrier faces the interior of the compact. If the cover is closed, this configuration is convenient for handheld manipulation and customary of a bi-fold compact.

When the article carrier is rotated downward and locked, then the inner surface of the bottom of the article carrier faces out of the compact and the compact assumes an A-frame configuration. The A-frame configuration is convenient for placing the compact on a surface. If a mirror is provided on the inner surface of the carrier, then a user can view herself in the mirror while using both hands to apply makeup or other perform some other activity. Optionally, there may be several orientations of the carrier and base that can be temporarily locked. Means of providing such temporary locks may be readily apparent to those of ordinary skill in the art. In an A-frame configuration, the cover may be opened or closed, but an opened cover may add stability to the compact as well as offering access to the cosmetic items in the base.

The base (10) houses one or more cosmetic items, such as a cosmetic preparation or applicator. Flat, planar compacts of the present invention are well suited to hold pressed powders typically pre-filled into metal or plastic pans. Thus, one or more metal pans (50) may fill some or all of the space within the base. Each pan may contain a different shade of one type of cosmetic or may contain different types of cosmetics. A means may be provided for discouraging the pans from falling out of the base. For example, the pans may glued into the base or secured with magnets or mechanical means. A portion of the inner space of the compact may also house one or more applicators (60) for applying the product. Typical applicators include brushes, combs, sponges, pencils, etc. The items in the base may be visible at all times, if a see-through cover (40) is provided. A see through cover includes a fully or partially transparent cover, a fully or partially translucent cover, a mostly opaque cover having a window, etc.

The article carrier (30) may house various types of items, but these will generally be hidden from the view when the article carrier is in the closed position. Preferably, the article carrier houses a mirror (70). The mirror may be secured in the article carrier by various means, for example, by gluing, or the mirror may be removable from the article carrier. When it is preferable to provide a mirror that is as large as possible, the entire inner surface of the bottom of the article carrier should be covered by a mirror. In this case, the dimensions of the mirror are very nearly the dimensions of the compact, minus the thickness of the article carrier walls.

Optionally, the ends of the pivots (34) may be provided with raised features that prevent them from backing out of the groove (15).

Optionally, snap fitments located on the base (10) and cover (40), respectively, may be provided, to hold the cover in a closed opened or intermediate position.

Many such enhancements may be apparent to a person skilled in the art, without enhancing the spirit of the invention, which is a convenient-to-use, unitary, cosmetic compact of increased stability, comprising a base, a hinged cover capable of rotating with respect to the base and an article carrier that is capable of translation and rotation with respect to the base, via a selective rotation mechanism. The compact may be held in the hand similar to a bi-fold compact or the compact may be place on a surface in various useful configurations, including extended base and stable A-frame configurations.

Surprisingly, the combination of the tri-fold effect and an article carrier with a selective rotation mechanism create a compact having an elegant, playful feel, while being versatile, stable, simple and inexpensive to manufacture. The combination of the decoupled motion of the article carrier with respect to the base and the fact that the cover and article carrier move independently, creates a versatile, convenient-to-use, compact that may be held in the hand similar to a bi-fold compact or placed on a surface in various useful configurations, including extended base and stable A-frame configurations, unlike any cosmetic compact in the prior art.

What is claimed is:

1. A tri-fold cosmetic compact comprising:

a base that comprises:

two lateral walls that each have a groove, wherein each groove has first and second sections; the first section being a straight groove that has a height, and that runs along one lateral wall of the base and that opens into the second section; the second section being a circular groove that has a diameter that is larger than the height of the straight groove;

a pair of parallel, straight walls bounding the straight groove; and a circular wall bounding the circular groove;

an article carrier connected to the base via a selective rotation mechanism, wherein the article carrier comprises two lateral walls, each having a pivot element on its interior, each pivot element being formed as a truncated cylinder having only one straight edge, wherein the straight edge is longer than the height of the straight groove, but shorter than the diameter of the circular groove; and a cover hingedly attached to the base, such that, the cover and article carrier are able to move independently of each other.

2. The compact of claim 1 wherein the pivot elements straight edge of the article carrier extend into the grooves of the base.

3. The compact of claim 2, wherein when the straight edge is in the straight grooves, downward rotation of the article carrier with respect to the base is prevented by the straight edge abutting the wall of the straight grooves and upward rotation of the article carrier is prevented by a portion of the article carrier contacting a portion of the base.

4. The compact of claim 3 wherein, when the straight edge is in the circular grooves, the article carrier can rotate either up or down, with respect to the base.

5. The compact of claim 4 wherein the article carrier is able to rotate at least 90° upward and at least 90° downward.

6. The compact of claim 5 wherein once the article carrier is rotated with respect to the base, the compact is able to maintain the rotated configuration against the weight of the compact.

7. The compact of claim 6 that is able to assume a stable A-frame configuration.

8. The compact of claim 1 wherein the cover is able to rotate at least 90°, with respect to the base.

9. The compact of claim 8 that is able to assume an extended base configuration.

10. The compact of claim 8 that is able to assume a lying flat configuration.

11. The compact of claim 1 wherein the base is capable of receiving one or more cosmetic items.

12. The compact of claim 11 wherein one or more skin preparations are disposed in the base.

13. The compact of claim 11 wherein one or more applicators are disposed in the base.

14. The compact of claim 1 wherein the article carrier is capable of receiving one or more auxiliary articles.

15. The compact of claim 14 wherein a mirror is disposed in the article carrier.

16. The compact of claim 1 wherein at least a portion of the cover is see through.

17. The compact of claim 16 wherein at least a portion of the cover is transparent.

* * * * *